US008071871B2

(12) United States Patent
Peavey

(10) Patent No.: US 8,071,871 B2
(45) Date of Patent: Dec. 6, 2011

(54) ELECTROMECHANICAL SERVO ASSISTED DRUM

(75) Inventor: Hartley D. Peavey, Meridian, MS (US)

(73) Assignee: Peavey Electronics Corporation, Meridian, MS (US)

( * ) Notice: Subject to any disclaimer, the term of this patent is extended or adjusted under 35 U.S.C. 154(b) by 346 days.

(21) Appl. No.: 12/261,401

(22) Filed: Oct. 30, 2008

(65) Prior Publication Data

US 2010/0107858 A1 May 6, 2010

(51) Int. Cl.
*G10H 3/14* (2006.01)

(52) U.S. Cl. ..... 84/725; 84/411

(58) Field of Classification Search ..... 84/725, 84/411 R

See application file for complete search history.

(56) References Cited

U.S. PATENT DOCUMENTS

| | | | | | |
|---|---|---|---|---|---|
| 3,162,730 | A * | 12/1964 | Owen, Jr. | ..... | 369/88 |
| 3,188,389 | A * | 6/1965 | Janisio | ..... | 381/65 |
| 4,941,389 | A | 7/1990 | Wendler | | |
| 5,056,400 | A * | 10/1991 | Wachi et al. | ..... | 84/600 |
| 5,353,674 | A | 10/1994 | Volpp | | |
| 5,430,245 | A | 7/1995 | Rogers | | |
| 7,282,633 | B1 * | 10/2007 | Coolidge | ..... | 84/723 |
| 2005/0286729 | A1 * | 12/2005 | Harwood et al. | ..... | 381/152 |
| 2008/0044044 | A1 * | 2/2008 | Madaffari et al. | ..... | 381/186 |

* cited by examiner

*Primary Examiner* — Jianchun Qin
(74) *Attorney, Agent, or Firm* — Matthew B. Dernier, Esq.; Gibson & Dernier, LLP

(57) ABSTRACT

A drum includes a shell having first and second, spaced apart ends defining an interior volume; first and second drumheads, each stretched over a respective one of the first and second ends of the shell; and an electromechanical driver having a moving coil element operable to move the first drumhead in response to an electrical drive signal.

20 Claims, 4 Drawing Sheets

ELECTROMECHANICAL SERVO ASSISTED DRUM

BACKGROUND OF THE INVENTION

The present invention relates to a drum having an electromechanical servo assisted output, which is operable to improve the output amplitude characteristics of the drum.

A drum is possibly the simplest musical instrument, comprising an enclosure or shell of some kind, and a membrane (or head) stretched over an opening of the shell. Modern drums emerged in the late 1800s, and included a shell and one or two heads that were secured to the drum shell by a wooden or metal rim (or hoop) that served to fasten and tension the head to the shell. Machine screws extended through the rim into a series of metal fixtures (called lugs) that were attached around a periphery of the shell. In order to create a secure mounting structure for the lugs, the shell itself was fairly thick to provide enough strength to withstand the pull of the rim as the head was tensioned over the end of the shell.

The operational principle of a drum is fairly simple: drums are resonant systems, essentially Helmholtz resonators. Energy is imparted to the head by striking it with some type of object, such as a stick, mallet or a player's hand. The energy imparted to the head activates air inside the shell of the drum, thereby creating a resonant effect, which is recognizable as what is generally referred to as a drum beat. The maximum acoustic output of a drum is established by the passive structures of the drum construction, e.g., the size and mass of the shell, the size and tension of the drumhead(s), resonant characteristics, and other physical characteristics. Conventional drums today are of very similar construction and operation as the drums of the 1800s (and even those of thousands of years ago) and, therefore, include limitations of the level of acoustic power available from the drum.

Until just a few years ago, the drum was one of the loudest instruments in a band. But today's bands include high power amplifiers for guitars and basses (as well as amplified keyboards and synthesizers). Since the drummer in every band is depended on to set the beat, it is vital that (especially) the bass drum be heard by the other members of the band, as well as the audience. This has created the need for drummers to use microphones and auxiliary sound systems to amplify their drums, both to the drummer himself (drum monitor systems) and to project to the audience, enabling the drummer to be loud enough to be heard along with the other amplified instruments in the band.

The problem with amplifying the drums in a band is that it increases the complexity, amount of gear, sources of noise, etc., because one must employ an external microphone, amplifiers, monitors, extra speakers, etc. The potential for acoustic feedback from the monitors/speakers into the microphone(s) picking up the drum is significant because a microphone is a relatively wideband pickup and the amplification employed is significant.

Therefore, it is desirable to improve the output from a drum without requiring many, or any, external components, and to reduce the likelihood of feedback attendant with drum amplification.

SUMMARY OF THE INVENTION

In accordance with one or more embodiments of the present invention a drum includes: a shell having first and second, spaced apart ends defining an interior volume; first and second drumheads, each stretched over a respective one of the first and second ends of the shell; and an electromechanical driver having a moving coil element operable to move the first drumhead in response to an electrical drive signal, wherein the electromechanical driver is disposed within the interior volume of the shell.

The drum may further include a pickup disposed in communication with the second drumhead and operable to produce a first electrical signal in response to mechanical vibration of the second drumhead. The pickup is preferably also disposed within the interior volume of the shell.

The drum further includes an amplifier circuit operable to electrically process the first electrical signal to produce the electrical drive signal to the electromechanical driver. The amplifier circuit may include a phase adjustment circuit operable to adjust a phase between the first electrical signal and the electrical drive signal to match acoustic propagation of sound pressure waves from the second drumhead to the first drumhead. In other words, the phase adjustment circuit may be operable to introduce a time or phase delay from the first electrical signal to the electrical drive signal such that sound pressure waves resulting from vibrations of the second drumhead to the first drumhead arrive in phase with movement of the first drumhead in response to the electrical drive signal.

Other aspects, features, and advantages of the present invention will be apparent to one skilled in the art from the description herein taken in conjunction with the accompanying drawings.

DESCRIPTION OF THE DRAWINGS

For the purposes of illustration, there are forms shown in the drawings that are presently preferred, it being understood, however, that the invention is not limited to the precise arrangements and instrumentalities shown.

DETAILED DESCRIPTION OF THE PREFERRED EMBODIMENTS

Figure 1:
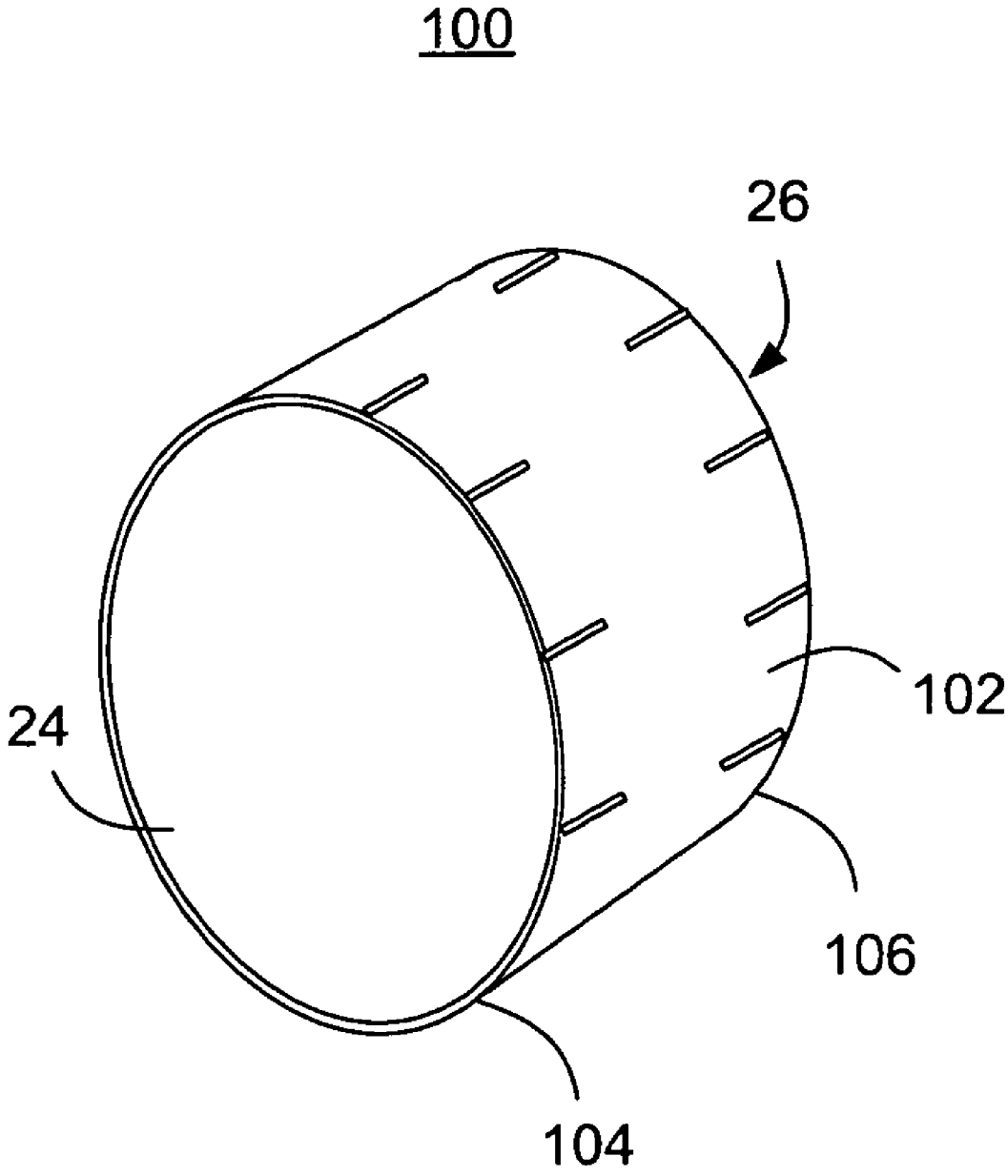
FIG. 1 is a front perspective view of a drum having an electromechanical servo assisted output in accordance with one or more aspects of the present invention.
Figure 2:
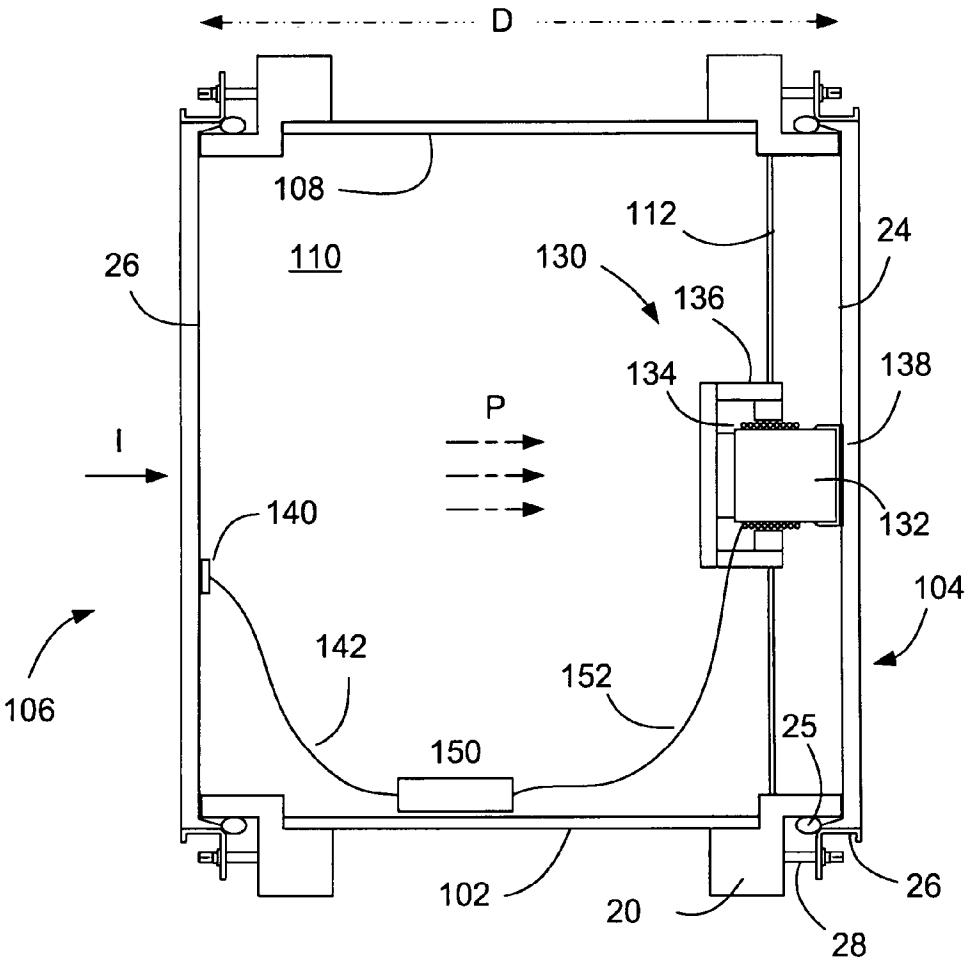
FIG. 2 is a cross-sectional side view of the drum of FIG. 1 illustrating interior features of the drum, including the electromechanical servo, in accordance with one or more further aspects of the present invention.

With reference to the drawings, wherein like numerals indicate like elements, there is shown in FIG. 1 a drum 100 in accordance with one or more aspects of the present invention. For purposes of discussion, it is assumed that the drum 100 is a bass drum of a size and shape commonly found in rock, blues and jazz bands. The drum 100 includes a shell 102 having first and second, spaced apart ends 104, 106, and an interior surface 108 defining an interior volume 110. As best seen in FIG. 2, a drumhead 24 may be stretched over the first end 104 of the shell 102 and secured using a rim (or hoop) 26 and lug components 28. The rim 26 engages a bead 25 of the drumhead 24 in order to evenly stretch the drumhead 24 over the first end 104 of the shell 102. A second drumhead 26 of the same or similar construction as the drumhead 24 may be employed and stretched over the second end 106 of the shell 102.

As in a conventional drum, vibrations of the second drumhead 26 resulting from an impact I (see arrow at left of FIG. 2) initiate sound pressure waves P that propagate through the interior volume 110 over distance D and impinge on the first drumhead 24, causing the first drumhead 24 to vibrate and create an audible drum beat. Unlike conventional drums, however, the drum 100 includes an electromechanical driver to assist in moving the first drumhead 24 in order to generate much louder audible output.

Interposed within the shell 102 between the first and second drumheads 24, 26 is an electromechanical driver 130. The electromechanical driver 130 converts received electrical signals into linear movement of a coupling element 132. In concept, the electromechanical driver 130 (shown only schematically) may operate in a similar way as a loudspeaker, whereby a coil 134 is disposed in a fixed magnetic field of a permanent magnet 136. The received electrical signals pass through the coil 134, thereby generating corresponding electromagnetic fields, which interact with the fixed magnetic field of the permanent magnet 136. The coil 134 is supported by a bobbin, which is mechanically connected to or an integral part of the coupling element 132 (taken separately or together these elements may be considered a moving coil element). Thus, the coupling element 132 moves in linear relation to the electrical signals received by the electromechanical driver 130.

Figure 3:
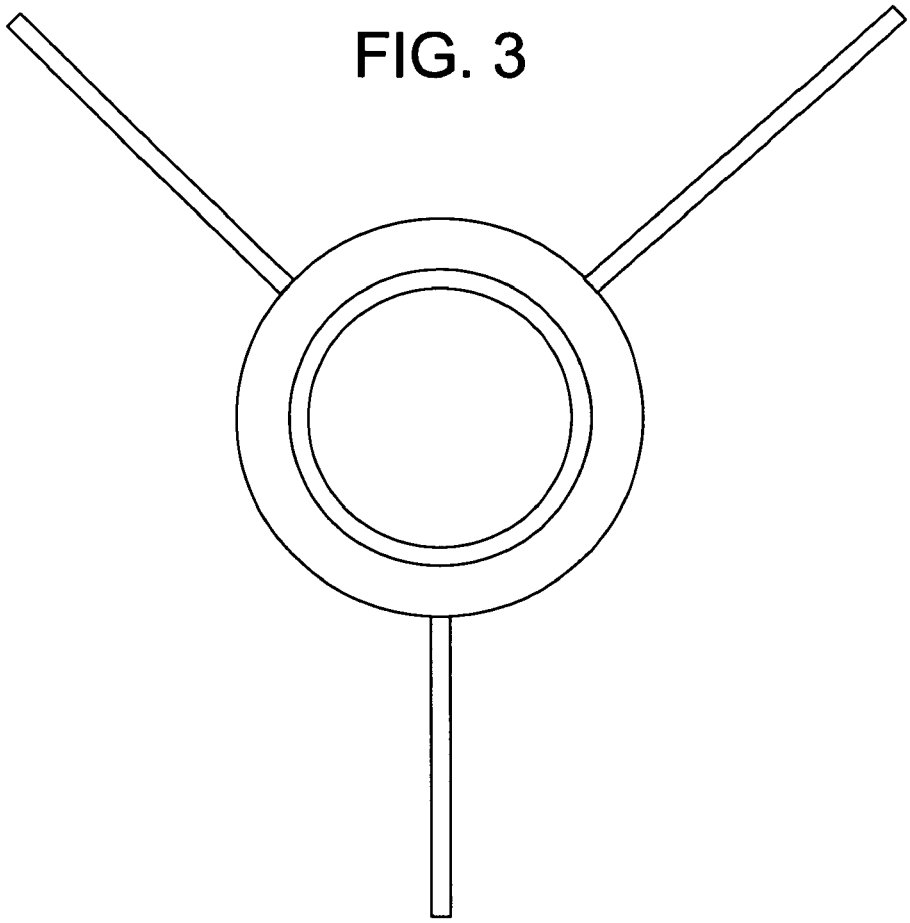
FIG. 3 is a front view of the electromechanical portion of the drum of FIG. 2.

As best seen in FIG. 3, the electromechanical driver 130 is fixed in position by a series of rods 112 (or other suitable structural elements). In the embodiment illustrated, the rods 112 are in a "Y" configuration, each connecting at one end to the permanent magnet 136 and at the other end to the physical structure of the drum, preferably to a radial bridge 20 thereof. Although less desirable, the rods 112 may be coupled to the shell 102. In any event, the rods 112 fix the position of the electromechanical driver 130 so that the linear movement of the coupling element 132 can cause corresponding movement of the first drumhead 24.

Figure 4:
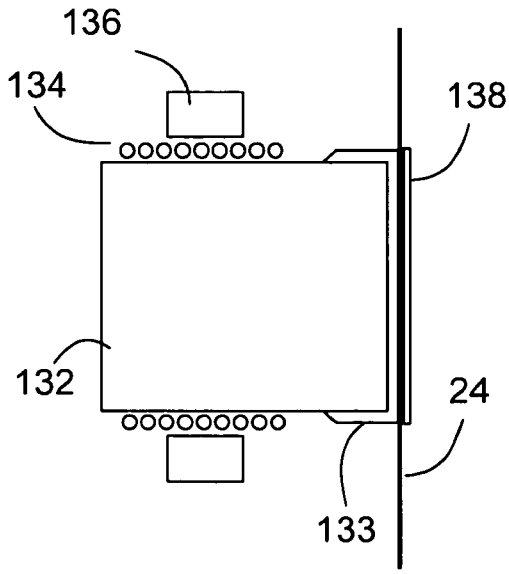
FIG. 4 is a larger side-view of the electromechanical portion of the drum of FIG. 2.

The first drumhead 24 has an interior surface disposed towards the interior volume 110 of the shell 102 and an exterior surface facing away from the interior volume 110 of the shell 102. The coupling element 132 of the electromechanical driver 130 is preferably coupled to the interior surface of the first drumhead 24, and preferably coupled to a central portion of the first drumhead 24. Any known or hereinafter developed technology may be employed to couple the electromechanical driver 130 to the interior surface of the first drumhead 24 so long as the functionality of the system as described herein is achievable. As best seen in FIG. 4, the preferred technique of connecting the electromechanical driver 130 to the first drumhead 24 is via a magnet 138. In particular, the electromechanical driver 130 includes a "cap" of ferrous material 133 on the end of the coupling element 132, which engages the interior surface of the first drumhead 24. The magnet 138 is preferably of a disc shape and magnetically couples with the ferrous material 133 to sandwich the first drumhead 24 therebetween. Thus, the linear movement of the coupling element 132 of the electromechanical driver 130 will be followed by the first drumhead 24 in both forward and rearward directions. Although any suitable material may be employed to form the magnet 138, niodinium, such as niodinium-iron-boron is preferred.

The drum 100 further includes a pickup 140 disposed in communication with the second drumhead 26. The pickup 140 is operable to produce a first electrical signal on line 142 in response to mechanical vibration of the second drumhead 26, such as in response to a strike I. Preferably, the pickup 140 is disposed within the interior volume 110 of the shell 102. The pickup may be implemented using any of the known technologies or technologies developed hereafter for converting mechanical movement or acoustic energy into electrical signals. By way of example, the pickup 140 may be implemented in accordance with one or more embodiments of the moving coil/magnet pickup disclosed in U.S. Pat. No. 4,941,389, which is incorporated herein in its entirety.

The electrical signal on line 142 is input into an amplifier circuit 150, also preferably disposed within the interior volume 110 of the shell 102. The amplifier circuit 150 is preferably operable to electrically process the electrical signal on line 142 to produce an electrical drive signal on line 152 to the electromechanical driver 130.

Figure 5:
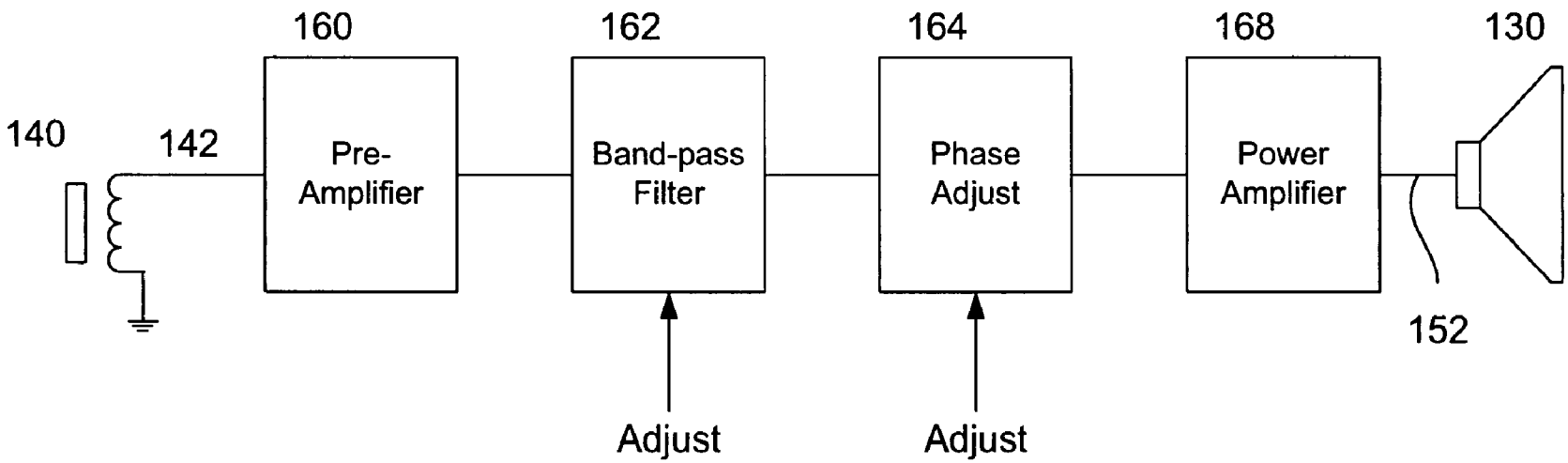
FIG. 5 is a block diagram of an electrical (amplifier) circuit operable to drive the electromechanical servo of the drum.

With reference to FIG. 5, the amplifier circuit 150 includes a preamplifier circuit 160, a band-pass filter circuit 162, a phase or delay adjustment circuit 164 and a power amplifier circuit 168. It is understood that the order of the above-listed circuits may be re-arranged to some extent as would be apparent to one of ordinary skill in the art. The pre-amplifier circuit 160 is operable to provide some amplification and/or impedance matching between the pickup 140 and the remainder of the amplifier circuit 150. Depending on the type of pickup 140 employed and the impedances involved, the pre-amplifier circuit 160 might be eliminated or implemented by way of passive components only. The band-pass filter 162 is operable to limit the frequency response of the amplifier 150, such that acoustic feedback is avoided. Preferably, the band-pass filter 162 is adjustable (preferably user-adjustable) so that tuning against acoustic feedback may be achieved. The pass-band of the band-pass filter 162 may be in the range of about 30-100 Hz.

The amplifier circuit 150 also includes a phase or delay adjustment circuit 164 operable to adjust (preferably by user adjustment) the phase or delay between the first electrical signal on line 142 and the electrical drive signal on line 152 to match the acoustic propagation of the sound pressure waves P from the second drumhead 26 to the first drumhead 24. In other words, the phase or delay adjustment circuit 164 is operable to introduce a time delay or phase shift from the first electrical signal (line 142) to the electrical drive signal (line 152) such that the sound pressure waves P arrive at the first drumhead 24 in phase with movement of the first drumhead 24 in response to the electrical drive signal.

The phase or delay compensation provided by the phase or delay adjustment circuit 164 is important. When the rear drumhead 26 is struck, the sound pressure wave P travels forward at the speed of sound towards, and impacts, the front drumhead 24. Because drums vary considerably in the distance D between the rear and front drumheads 26, 24, it is important that the electromechanical assist from the driver 130 to the front drumhead 24 matches the phase of the pressure wave P. If one senses the movement of the rear drumhead 26 when it is struck using the pickup 140, the electrical signal generated on line 142 moves through the electronics at the speed of light and the driver 130 (without phase or delay compensation) would begin moving the front drumhead 24 well in advance of the arrival of the sound pressure wave P. In order to compensate for the delay in the time that the sound pressure wave P reaches the front drumhead 24, the phase or delay adjustment circuit 164 adjusts the phase of the amplifier 150 or incorporates a delay sufficient to match the arrival of the sound pressure wave P at the front drumhead 24. This ensures that sound is additive at the front drumhead 24, and that sound cancellation is minimized or eliminated.

The phase or delay adjustment circuit 164 may be implemented using any of the known or hereinafter developed technologies, such as analog circuitry, digital circuitry, digital signal processing circuits, software implemented circuits, etc.

The power amplifier 168 provides sufficient current and voltage such that the electrical drive signal on line 152 is capable of moving the coupling element 132 of the electromechanical driver 130 and, thus, the first drumhead 24.

In accordance with at least one further aspect of the present invention, the methods and apparatus described above may be achieved utilizing suitable hardware, such as that illustrated in the figures. Such hardware may be implemented utilizing any of the known technologies, such as standard digital circuitry, any of the known processors that are operable to execute software and/or firmware programs, one or more programmable digital devices or systems, such as programmable read only memories (PROMs), programmable array logic devices (PALs), etc. Furthermore, although the apparatus illustrated in the figures are shown as being partitioned into certain functional blocks, such blocks may be implemented by way of separate circuitry and/or combined into one or more functional units. Still further, the various aspects of the invention may be implemented by way of software and/or firmware program(s) that may be stored on a suitable storage medium or media (such as floppy disk(s), memory chip(s), etc.) for transportability and/or distribution.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A drum, comprising:

a shell having first and second, spaced apart ends defining an interior volume;

first and second drumheads, each stretched over a respective one of the first and second ends of the shell, the first drumhead including an interior surface disposed towards the interior volume of the shell and an exterior surface facing away from the interior volume of the shell;

an electromechanical driver having a moving coil element operable to move the first drumhead in response to an electrical drive signal; and a pickup disposed in communication with the second drumhead and operable to produce a first electrical signal in response to mechanical vibration of the second drumhead, wherein the electromechanical driver is disposed within the interior volume of the shell, and the moving coil element of the electromechanical driver is mechanically connected to the interior surface of the first drumhead.

2. The drum of claim wherein the pickup is disposed within the interior volume of the shell.

3. The drum of claim 1, further comprising an amplifier circuit operable to electrically process the first electrical signal to produce the electrical drive signal to the electromechanical driver.

4. The drum of claim 3, wherein the amplifier circuit includes a phase or delay adjustment circuit operable to adjust a phase between the first electrical signal and the electrical drive signal to match acoustic propagation of sound pressure waves from the second drumhead to the first drumhead.

5. The drum of claim 4, wherein the phase or delay adjustment circuit is operable to introduce a time delay from the first electrical signal to the electrical drive signal such that sound pressure waves resulting from vibrations of the second drumhead to the first drumhead arrive in phase with movement of the first drumhead in response to the electrical drive signal.

6. The drum of claim 5, wherein the time delay adjustment circuit is user adjustable.

7. The drum of claim 4, wherein the phase adjustment circuit is user adjustable.

8. The drum of claim 3, wherein the amplifier circuit includes a narrow band pass filter function operable to limit the frequency response of the amplifier.

9. The drum of claim 8, wherein the band pass filter is user adjustable.

10. The drum of claim 1, wherein the moving coil element of the electromechanical driver is coupled to a central portion of the first drumhead.

11. The drum of claim 1, wherein:

the moving coil element includes a ferrous material coupled to one end thereof in contact with the first drumhead; and the drum further comprises a magnet that is positioned on an exterior surface of the first drumhead and in magnetic communication with the ferrous material to sandwich the first drumhead therebetween.

12. The drum of claim 1, wherein the moving coil element includes a mechanism or substance coupled to one end thereof in contact with the first drumhead.

13. A method of operating a drum, the drum including a shell having first and second, spaced apart ends defining an interior volume, and first and second drumheads, each stretched over a respective one of the first and second ends of the shell, the first drumhead including an interior surface disposed towards the interior volume of the shell and an exterior surface facing away from the interior volume of the shell, the method comprising:

producing a first electrical signal indicative of vibrations of the second drumhead of the drum; and producing an electrical drive signal in response to the first electrical signal of sufficient voltage and current to drive an electromechanical driver having a moving coil element, the moving coil element being mechanically connected to the interior surface of the first drumhead and operating to move the first drumhead in response to the electrical drive signal.

14. The method of claim 13, further comprising adjusting a phase between the first electrical signal and the electrical drive signal to match acoustic propagation of sound pressure waves from the second drumhead to the first drumhead.

15. The method of claim 13, further comprising introducing a time delay from the first electrical signal to the electrical drive signal such that sound pressure waves resulting from vibrations of the second drumhead to the first drumhead arrive in phase with movement of the first drumhead in response to the electrical drive signal.

16. A drum, comprising:

a shell having first and second, spaced apart ends defining an interior volume;

first and second drumheads, each stretched over a respective one of the first and second ends of the shell;

an electromechanical driver disposed within the interior volume of the shell and having a moving coil element operable to move the first drumhead in response to an electrical drive signal; and an amplifier circuit operating to electrically process an electrical input signal to produce the electrical drive signal to the electromechanical driver, and including a phase or delay adjustment circuit operating to adjust a phase between the electrical input signal and the electrical drive signal to account for acoustic propagation of sound pressure waves from the second drumhead to the first drumhead.

17. A drum, comprising:

a shell having first and second, spaced apart ends defining an interior volume;

first and second drumheads, each stretched over a respective one of the first and second ends of the shell, the first drumhead including an interior surface disposed towards the interior volume of the shell and an exterior surface facing away from the interior volume of the shell;

a pickup disposed in communication with the second drumhead and operable to produce a first electrical signal in response to mechanical vibration of the second drumhead; and an amplifier circuit operable to electrically process the first electrical signal to produce the electrical drive signal to the electromechanical driver, wherein the electromechanical driver is disposed within the interior volume of the shell, and the moving coil element of the electromechanical driver is mechanically connected to the interior surface of the first drumhead.

18. The drum of claim 17, wherein at least one of:

the amplifier circuit includes a phase or delay adjustment circuit operable to adjust a phase between the first electrical signal and the electrical drive signal to match acoustic propagation of sound pressure waves from the second drumhead to the first drumhead; and the phase or delay adjustment circuit is operable to introduce a time delay from the first electrical signal to the electrical drive signal such that sound pressure waves resulting from vibrations of the second drumhead to the first drumhead arrive in phase with movement of the first drumhead in response to the electrical drive signal.

19. The drum of claim 17, wherein at least one of: the phase adjustment circuit is user adjustable; and the time delay adjustment circuit is user adjustable.

20. The drum of claim 17, wherein at least one of:

the amplifier circuit includes a narrow band pass filter function operable to limit the frequency response of the amplifier; and the band pass filter is user adjustable.

* * * * *